US009171526B2

(12) United States Patent
Inada et al.

(10) Patent No.: US 9,171,526 B2
(45) Date of Patent: Oct. 27, 2015

(54) DISPLAY DEVICE, METHOD FOR CONTROLLING DISPLAY DEVICE, PROGRAM, AND RECORDING MEDIUM

(75) Inventors: Ken Inada, Osaka (JP); Fumiyuki Kobayashi, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 369 days.

(21) Appl. No.: 13/808,769

(22) PCT Filed: Jul. 6, 2011

(86) PCT No.: PCT/JP2011/065496
§ 371 (c)(1),
(2), (4) Date: Jan. 7, 2013

(87) PCT Pub. No.: WO2012/008342
PCT Pub. Date: Jan. 19, 2012

(65) Prior Publication Data

US 2013/0106901 A1 May 2, 2013

(30) Foreign Application Priority Data

Jul. 13, 2010 (JP) ..... 2010-159150

(51) Int. Cl.
*G09G 5/10* (2006.01)
*G09G 3/34* (2006.01)
(Continued)

(52) U.S. Cl.
CPC ..... *G09G 5/10* (2013.01); *G09G 3/3406* (2013.01); *G09G 3/3611* (2013.01); *G09G 5/026* (2013.01); *G09G 2300/0452* (2013.01); *G09G 2320/0646* (2013.01); *G09G 2320/0666* (2013.01)

(58) Field of Classification Search
None
See application file for complete search history.

(56) References Cited

U.S. PATENT DOCUMENTS

2007/0242006 A1 10/2007 Lin
2008/0204480 A1 8/2008 Van Mourik et al.
(Continued)

FOREIGN PATENT DOCUMENTS

JP 2007-286618 A 11/2007
JP 2009-053669 A 3/2009
(Continued)

OTHER PUBLICATIONS

Peters II, Richard A. "Mathematical morphology for angle-valued images." Electronic Imaging'97. International Society for Optics and Photonics, 1997.*
(Continued)

*Primary Examiner* — Mark Zimmerman
*Assistant Examiner* — Sarah Le
(74) *Attorney, Agent, or Firm* — Hauptman Ham, LLP

(57) ABSTRACT

A display device includes a display panel having pixels each constituted by red, green, blue, and white subpixels and a backlight, further including: a grayscale ratio calculating section acquiring RGB data and calculating a ratio of the lowest to the highest of RGB grayscales in each pixel; a detection section detecting, from the RGB data, a ratio of the number of target pixels in one frame; a conversion coefficient calculating section acquiring, by using the detected ratio, a conversion coefficient for converting the RGB data into RGBW data; a RGB data conversion section converting the RGB data into the RGBW data per pixel by using the conversion coefficient; and a display control section generating, from the RGBW data, an image to be displayed on the display panel and causing the display panel to display the image.

7 Claims, 8 Drawing Sheets

(51) Int. Cl.
*G09G 3/36* (2006.01)
*G09G 5/02* (2006.01)

(56) References Cited

U.S. PATENT DOCUMENTS

| | | | | |
|---|---|---|---|---|
| 2009/0002298 | A1* | 1/2009 | Furukawa | 345/88 |
| 2009/0059078 | A1 | 3/2009 | Kim et al. | |
| 2009/0085847 | A1 | 4/2009 | Morisue et al. | |
| 2009/0207182 | A1 | 8/2009 | Takada et al. | |

FOREIGN PATENT DOCUMENTS

| | | | |
|---|---|---|---|
| JP | 2009-086054 | A | 4/2009 |
| JP | 2009-192887 | A | 8/2009 |
| WO | 2006077554 | A2 | 7/2006 |
| WO | 2007125630 | A1 | 11/2007 |

OTHER PUBLICATIONS

International Search Report corresponding to PCT/JP2011/065496, dated Aug. 9, 2011.

* cited by examiner

DISPLAY DEVICE, METHOD FOR CONTROLLING DISPLAY DEVICE, PROGRAM, AND RECORDING MEDIUM

RELATED APPLICATIONS

The present application is a National Phase of International Application Number PCT/JP2011/065496, filed Jul. 6, 2011, and claims priority from, Japanese Application Number 2010-159150, filed Jul. 13, 2010.

TECHNICAL FIELD

The present invention relates to a display device including a display panel having pixels each including four subpixels of R, G, B, and W, a method for controlling the display device, a program, and a recording medium.

BACKGROUND ART

In general, a color image display device expresses various colors by mixing three colors of R (red), G (green), and B (blue). For example, each pixel of a display panel is provided with R, G, and B color filters, and light from a backlight is transmitted by these color filters so that light of R, G, and B is emitted.

Recently, there is known a technique in which each pixel is provided with a W (white) subpixel in addition to R, G, and B subpixels. In this case, image data acquired by a color image display device is normally in the form of RGB data, and accordingly it is necessary to convert the image data into data corresponding to a pixel of RGBW.

For example, Patent Literatures 1 and 2 describe a method in which a liquid crystal display device having RGBW pixel sequences converts RGB data into RGBW data.

CITATION LIST

Patent Literature 1

Japanese Patent Application Publication, Tokukai, No. 2007-286618 (published on Nov. 1, 2007)

Patent Literature 2

Japanese Patent Application Publication, Tokukai, No. 2009-86054 (published on Apr. 23, 2009)

SUMMARY OF INVENTION

Technical Problem

However, when colors are expressed by a pixel constituted by four subpixels of R, G, B, and W, there is a case where colors such as R, G, B, C (cyan), M (magenta), and Y (yellow) are displayed somberly.

This is because addition of a W subpixel results in relative reduction of areas of R, G, and B subpixels and thus results in insufficient luminance for R, G, and B. This phenomenon is likely to occur when yellow is displayed in particular. FIG. 12 is a view showing how colors are displayed when RGB data is converted into RGBW data by a conventional method.

In FIG. 12, in RGB data at the left side, a yellow display region 60 is adjacent to a white display region 61, and yellow is displayed vividly. However, when the RGB data is converted into RGBW data, luminance of RGB drops, so that yellow displayed in the yellow display region 60 looks somber.

The methods described in Patent Literatures 1 and 2 do not consider this problem at all.

The present invention was made in view of the foregoing problem. An object of the present invention is to provide a display device whose display panel having pixels each constituted by RGBW subpixels is capable of displaying colors vividly and with high luminance.

Solution to Problem

In order to solve the foregoing problem, a display device in accordance with one aspect of the present invention is a display device including a display panel having pixels each constituted by subpixels of red (R), green (G), blue (B), and white (W), and a backlight for emitting light to the display panel, the display device further including: calculating means for acquiring RGB data and calculating a ratio of a lowest grayscale to a highest grayscale of RGB grayscales in each pixel which are indicated by the acquired RGB data; detection means for determining that a pixel whose ratio calculated by the calculating means is not more than a predetermined value is a target pixel to be detected, and detecting, from the RGB data, a ratio of the number of the target pixel in one frame; conversion coefficient acquiring means for acquiring, by using the ratio detected by the detection means, a conversion coefficient for converting the RGB data into RGBW data; conversion means for converting the RGB data into the RGBW data with respect to each pixel by using the conversion coefficient; and display means for generating, from the RGBW data to which the RGB data has been converted by the conversion means, an image to be displayed on the display panel, and causing the display panel to display the image.

In order to solve the foregoing problem, a method in accordance with one aspect of the present invention is a method for controlling a display device including a display panel having pixels each constituted by subpixels of red (R), green (G), blue (B), and white (W), and a backlight for emitting light to the display panel, the method comprises the steps of: (i) acquiring RGB data and calculating a ratio of a lowest grayscale to a highest grayscale of RGB grayscales in each pixel which are indicated by the acquired RGB data; (ii) determining that a pixel whose ratio calculated in the step (i) is not more than a predetermined value is a target pixel to be detected, and detecting, from the RGB data, a ratio of the number of the target pixel in one frame; (iii) acquiring, by using the ratio detected in the step (ii), a conversion coefficient for converting the RGB data into RGBW data; (iv) converting the RGB data into the RGBW data by using the conversion coefficient after the step (iii); and (v) generating, from the RGBW data to which the RGB data has been converted in the step (iv), an image to be displayed on the display panel, and causing the display panel to display the image.

With the arrangement, in one aspect of the present invention, in order that the display panel having pixels each constituted by subpixels of RGBW displays an image, RGB data is converted into RGBW data. At that time, the conversion coefficient for converting RGB data into RGBW data is acquired in accordance with the ratio of the number of the target pixel in RGB data per one frame, and RGBW data is generated by using the acquired conversion coefficient.

RGB data is a signal transmitted in the form of three colors of R, G, and B into which each of color components of an image to be displayed is decomposed. In general, pixels in a display panel are each constituted by three subpixels of R, G, and B, and accordingly image data acquired from an outside source for example is in the form of RGB data. In one aspect of the present invention, since each pixel is constituted by four subpixels of R, G, B, and W, it is necessary to convert the acquired RGB data into RGBW data.

The display panel having subpixels of R, G, B, and W has higher luminance than a display panel having subpixels of R, G, and B as a result of addition of W component. In this case, luminance of white increases, whereas luminance of colors such as R, G, and B decreases.

For example, some images are intended to have high priority on luminance, whereas some images are intended to have high priority on vividness of a color. The priority can be determined by counting how many pixels whose ratio of the lowest grayscale to the highest grayscale of RGB grayscales in one pixel is not more than the predetermined value are included in RGB data in one frame. The ratio by which a certain pixel is determined as the target pixel may be not more than 0.1 for example.

Therefore, by using the ratio of the number of the target pixel, it is possible to convert RGB data into RGBW data that allows displaying an image with high luminance when high priority is put on luminance and that allows displaying an image with vivid colors based on RGB when high priority is put on vividness of colors.

Therefore, in one aspect of the present invention, it is possible to display an image with high luminance and with vivid colors.

Advantageous Effects of Invention

The display device in accordance with one aspect of the present invention is a display device including a display panel having pixels each constituted by subpixels of red (R), green (G), blue (B), and white (W), and a backlight for emitting light to the display panel, the display device further including: calculating means for acquiring RGB data and calculating a ratio of a lowest grayscale to a highest grayscale of RGB grayscales in each pixel which are indicated by the acquired RGB data; detection means for determining that a pixel whose ratio calculated by the calculating means is not more than a predetermined value is a target pixel to be detected, and detecting, from the RGB data, a ratio of the number of the target pixel in one frame; conversion coefficient acquiring means for acquiring, by using the ratio detected by the detection means, a conversion coefficient for converting the RGB data into RGBW data; conversion means for converting the RGB data into the RGBW data with respect to each pixel by using the conversion coefficient; and display means for generating, from the RGBW data to which the RGB data has been converted by the conversion means, an image to be displayed on the display panel, and causing the display panel to display the image. Accordingly, the display panel having pixels each constituted by subpixels of R, G, B, and W can display an image with high luminance and with vivid colors.

DESCRIPTION OF EMBODIMENTS

The following explains a display device in accordance with an embodiment of the present invention with reference to FIGS. 1 to 11.

(Configuration of Display Device 100)

Figure 1:
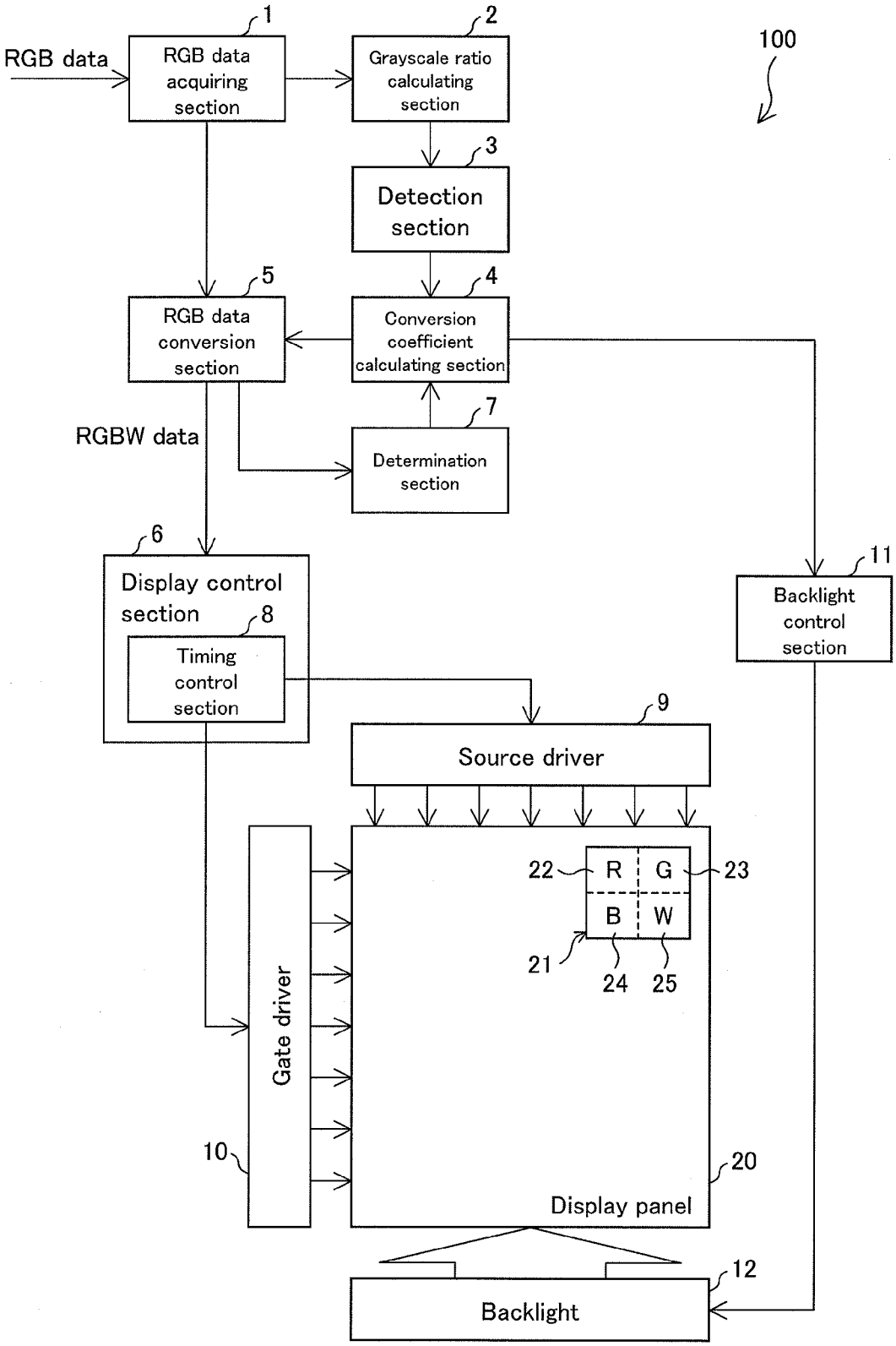
FIG. 1 is a block diagram showing a configuration of a display device in accordance with an embodiment of the present invention.

FIG. 1 is a block diagram showing a configuration of a display device 100 in accordance with an embodiment of the present invention.

As shown in FIG. 1, the display device 100 includes a RGB data acquiring section 1, a grayscale ratio calculating section 2 (calculating means), a detection section 3 (detection means), a conversion coefficient calculating section 4 (conversion coefficient acquiring means), a RGB data conversion section 5 (conversion means), a display control section 6 (display means), a determination section 7 (determination means), a timing control section 8, a source driver 9, a gate driver 10, a backlight control section 11 (light source control means), a backlight 12, and a display panel 20.

The display device 100 has pixel sequences of R (red), G (green), B (blue), and W (white). In the present embodiment, as shown in FIG. 1, a pixel 21 is constituted by four subpixels 22, 23, 24, and 25. A plurality of pixels 21 are arranged in a matrix manner (not shown) in the display panel 20.

In the present embodiment, the display panel 20 is a liquid crystal display panel. Individual pixels 21 of the display panel 20 are connected with the source driver 9 via a plurality of source lines, respectively, and are connected with the gate driver 10 via a plurality of gate lines, respectively. Consequently, by controlling voltages applied to individual pixels 21, transmittance of light in individual subpixels is changed.

Since the display device 100 in accordance with the present embodiment includes RGB subpixels, a desired color is reproduced by mixing three colors of red, green, and blue. These colors are obtained by arranging color filters of red, green, and blue in such a manner that the color filters correspond to RGB subpixels, respectively, and transmitting light emitted from the backlight 12 at the back of the display panel 20.

Since the pixel 21 includes the W subpixel 25 in addition to the RGB subpixels 22, 23, and 24, it is possible to make luminance of a displayed image higher than that of a display panel including RGB subpixels only.

In FIG. 1, RGBW subpixels 22, 23, 24, and 25 are arranged in a matrix consisting of two rows and two columns, and the R subpixel 22, the G subpixel 23, the B subpixel 24, and the W subpixel 25 are arranged at the upper left side, the upper right side, the lower left side, and the lower right side, respectively. However, arrangement of subpixels is not limited to this.

The RGB data acquiring section 1 acquires RGB data from an outside data source.

RGB data is a signal transmitted in the form of three colors of R, G, and B into which each of color components of an image to be displayed is decomposed. Specifically, depth of each of RGB colors is expressed gradually as a grayscale, and various colors can be expressed by controlling grayscales assigned to individual colors.

In the present embodiment, since 8 bit data is assigned to each of RGB colors, each color can be expressed in 255 grayscales. However, the present invention is not limited to this range, and the number of grayscales that can be expressed is changeable depending on data assigned to RGB. Examples of a data source of RGB data include a television tuner and a personal computer.

The grayscale ratio calculating section 2 calculates a ratio of the lowest grayscale to the highest grayscale of RGB grayscales (hereinafter also referred to as "grayscale ratio"). Specifically, the grayscale ratio calculating section 2 calculates a grayscale ratio in each pixel which is indicated by RGB data acquired by the RGB data acquiring section 1.

As described above, RGB data is designed such that RGB grayscales are assigned to each pixel so as to correspond to a color to be expressed, and the display device 100 achieves a desired grayscale by controlling transmittance of light of each subpixel. That is, a lower grayscale provides a darker color due to decrease in transmittance of light, whereas a higher grayscale provides more vivid red, green, or blue due to increase in transmittance of light.

Here, the ratio of the lowest grayscale to the highest grayscale of the RGB grayscales being 0 indicates that one of the RGB grayscales is 0. That is, a color is expressed by depth of one of RGB colors, or is expressed as a mixture of two of the RGB colors. Examples of colors expressed as above include red, green, blue, cyan (C), magenta (M), and yellow (Y).

The ratio of the lowest grayscale to the highest grayscale of the RGB grayscales being 1 indicates that each of the RGB grayscales has the same value, which provides a white color.

Based on the grayscale ratio calculated by the grayscale ratio calculating section 2, the detection section 3 determines target pixels to be detected out of all the pixels, and calculates a ratio of the number of the target pixels to the number of all the pixels. A criterion by which the detection section 3 determines a certain pixel as the target pixel may be such that the certain pixel has a grayscale ratio of not more than a predetermined constant value. In the present embodiment, a pixel whose grayscale ratio is not more than 0.1 is determined as the target pixel. However, the present invention is not limited to this, and there may be made a suitable arrangement in which, for example, a pixel whose grayscale ratio allows expressing a color close to R, G, B, C, M, or Y is determined as the target pixel.

When the grayscale ratio is 0, an expressible color is R, G, B, C, M, or Y for example. Accordingly, when the grayscale ratio is not more than 0.1, a color as close to R, G, B, C, M, or Y as possible is expressed. In the present embodiment, a pixel whose grayscale ratio is not more than 0.1 may be referred to as "deep-color pixel".

Using the ratio of the number of the target pixels to the number of all the pixels which is detected by the detection section 3, the conversion coefficient calculating section 4 calculates a conversion coefficient for converting RGB data into RGBW data.

The conversion coefficient is a value used when the RGB data conversion section 5 (mentioned later) converts RGB data into RGBW data. For example, in a case of generating RGBW data by an extension method, the conversion coefficient indicates how many times RGB grayscales indicated by RGB data are extended. In this specification, conversion into RGBW data may be also referred to as generation of RGBW data.

For example, when a color is expressed by a pixel constituted by four subpixels of R, G, B, and W, there is a case where colors such as R, G, B, C, M, and Y are displayed somberly. This is because addition of a W subpixel results in relative reduction of areas of R, G, and B subpixels and thus results in insufficient luminance for R, G, and B. This phenomenon is likely to occur when yellow is displayed in particular.

The display device 100 determines the conversion coefficient used when generating RGBW data in accordance with a ratio of the number of deep-color pixels, i.e. a ratio of areas expressed with colors such as R, G, B, C, M, and Y in an image to be displayed. Accordingly, it is possible to display colors such as R, G, B, C, M, and Y vividly.

As detailed later, the conversion coefficient calculating section 4 may calculate the conversion coefficient by using, for example, a curve indicative of a relation between the grayscale ratio calculated by the grayscale ratio calculating section 2 and the conversion coefficient. Furthermore, factors to be used when the conversion coefficient calculating section 4 calculates the conversion coefficient may be not only the ratio of the number of target pixels to the number of all the pixels but also the result of determination by the determination section 7 (mentioned later).

The RGB data conversion section 5 converts RGB data into RGBW data corresponding to individual pixels by using the conversion coefficient, and transmits the RGBW data obtained by the conversion to the display control section 6.

RGB data acquired by the RGB data acquiring section 1 is data corresponding to a pixel constituted by three subpixels of R, G, and B. Accordingly, in the display device 100 having pixels each constituted by four subpixels of R, G, B, and W, it is necessary to convert the acquired RGB data in such a manner as to correspond to such pixels.

For this reason, the RGB data conversion section 5 converts RGB data into RGBW data and then transmits the RGBW data to the display control section 6. Thus, the display device 100 having four subpixels of R, G, B, and W can display a color image appropriately.

From the RGBW data to which RGB data has been converted by the RGB data conversion section 5, the display control section 6 generates an image to be displayed by the display panel 2, and causes the display panel 2 to display the image.

In the present embodiment, the display control section 6 includes the timing control section 8. The timing control section 8 generates control signals corresponding to RGBW data, and transmits the control signals to the source driver 9 and the gate driver 10, respectively. Examples of the control signal include a source start signal, a source clock signal, a gate start signal, and a gate clock signal.

In accordance with the received control signals, the source driver 9 and the gate driver 10 apply voltages on the subpixels 22, 23, 24, and 25 of R, G, B, and W arranged in each of the pixels 21 to control transmittance of each of the pixels 21, thereby expressing colors.

The determination section 7 determines whether the ratio of the number of pixels specified to display a color with the maximum grayscale to the number of all the pixels in the generated RGBW data is more than a predetermined value or not.

Specifically, the determination section 7 refers to the RGBW data to which the RGB data has been converted by the RGB data conversion section 5, and counts the number of pixels specified to display an image with RGB grayscales one of which exceeds the maximum grayscale. Then, the determination section 7 determines whether a ratio of the number of the specified pixels to the number of all the pixels is more than a predetermined upper limit or less than a predetermined lower limit.

In the present embodiment, the maximum grayscale is 255 grayscale. However, the present invention is not limited to this. The predetermined upper limit may be 2% for example, and the predetermined lower limit may be 1% for example. However, the present invention is not limited to these values.

The result of the determination by the determination section 7 is used when the conversion coefficient calculating section 4 calculates a conversion coefficient in a next frame.

The backlight control section 11 calculates a conversion coefficient when the grayscale ratio is 1 by using the curve by which the conversion coefficient calculating section 4 calculates a conversion coefficient, and controls luminance of the backlight 12 in accordance with the calculated conversion coefficient.

Here, the conversion coefficient when the grayscale ratio is 1 is a coefficient by which RGB data is converted into RGBW data when a pixel expresses white. The backlight control section 11 controls the backlight 12 in such a manner that as the conversion coefficient when the grayscale ratio is 1 is larger, luminance of the backlight 12 is lower, and as the conversion coefficient is smaller, the luminance of the backlight 12 is higher.

This allows maintaining constant luminance when the conversion coefficient calculating section 4 controls grayscales in accordance with the ratio of deep-color pixels.

The backlight 12 emits light to the display panel 20. In the present embodiment, light emitted from the backlight 12 is not limited as long as it is white light. Examples of the light source of the backlight 12 include electroluminescence (EL), cold cathode fluorescent lamp (CCFL), and light-emitting diode (LED).

The display device 100 having such a configuration may be a display device of a television receiver, a personal computer, a mobile phone, a game machine etc.

(Generation of RGBW Data)

Next, an explanation is made as to a flow of a process in which the display device 100 in accordance with the present embodiment generates RGBW data from the acquired RGB data.

Figure 2:
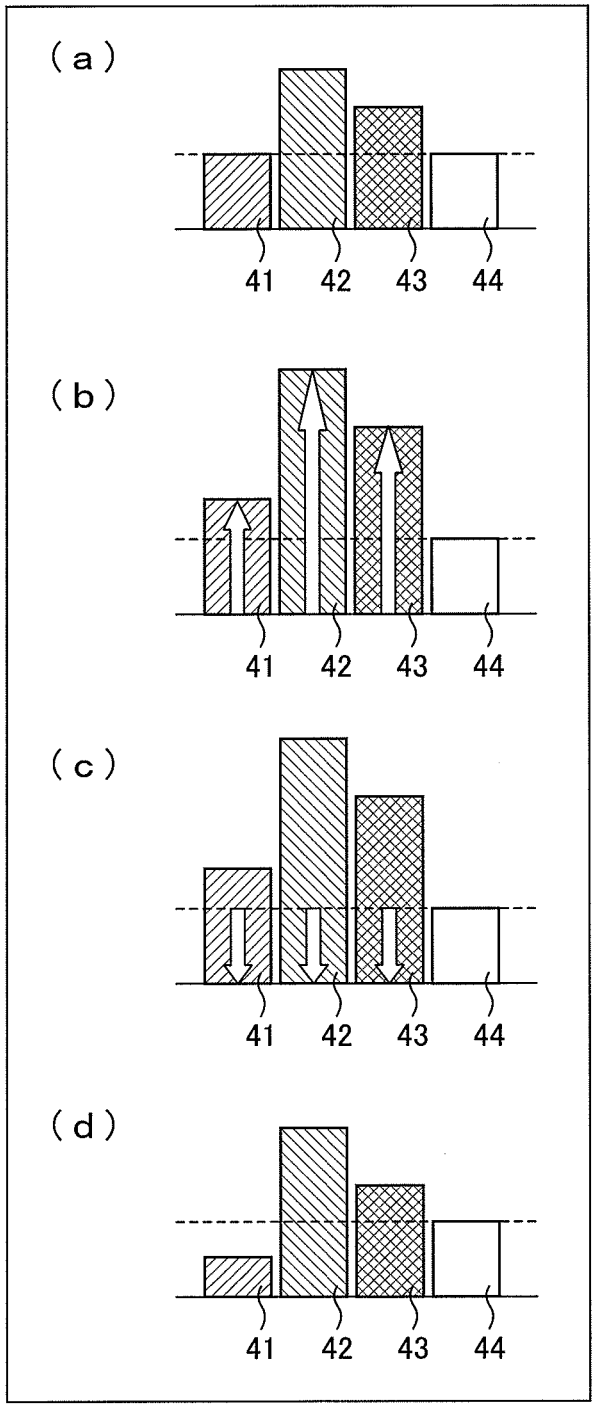
FIG. 2 is a view for explaining a procedure in which a RGB data conversion section of the display device shown in FIG. 1 converts RGB data into RGBW data.

FIG. 2 is a view for explaining a procedure in which the RGB data conversion section 5 of the display device 100 shown in FIG. 1 converts RGB data into RGBW data. Bar graphs shown in FIG. 2 indicate RGBW grayscales, respectively.

In the present embodiment, RGBW data is generated from the acquired RGB data by an extension method. Generation of RGBW data by an extension method is carried out in such a manner that the lowest grayscale of RGB grayscales indicated by RGB data is regarded as W grayscale and the RGB grayscales are multiplied with the conversion coefficient so that the RGB grayscales are extended, and the W grayscale is subtracted from the extended RGB grayscales, thereby converting the RGB data into RGBW data.

For example, in the graph shown in (a) of FIG. 2, RGB grayscales are indicated by components 41, 42, and 43, respectively. Out of them, the R grayscale indicated by the component 41 is the lowest, and accordingly the RGB data conversion section 5 regards the value of the R grayscale as W grayscale (component 44).

Next, the RGB grayscales are multiplied with the conversion coefficient calculated by the conversion coefficient calculating section 4 so that the RGB grayscales are extended ((b) of FIG. 2). Here, the conversion coefficient can range from 1 to 2 for example, and accordingly the RGB grayscales can be extended one to two times individually. It should be noted that the range of the conversion coefficient is not limited to the above.

Thereafter, the value of the W grayscale, i.e. the value of the R grayscale indicated by the original RGB data is subtracted from the extended RGB grayscales individually ((c) of FIG. 2). Thus, the RGB data is converted into RGBW data to which the grayscales shown in (d) of FIG. 2 are assigned.

As described above, when generating RGBW data, the RGB grayscales indicated by the original RGB data are multiplied with the conversion coefficient calculated by the conversion coefficient calculating section 4 so that the RGB grayscales are extended. Consequently, luminance of a pixel specified to adjust its grayscale by a small conversion coefficient becomes low, and luminance of a pixel specified to adjust its grayscale by a large conversion coefficient becomes high.

(Method for Calculating Conversion Coefficient)

An explanation is made below as to a method for calculating a conversion coefficient in accordance with the present embodiment.

Initially, the conversion coefficient calculating section 4 generates a curve used for calculating a conversion coefficient.

Figure 3:
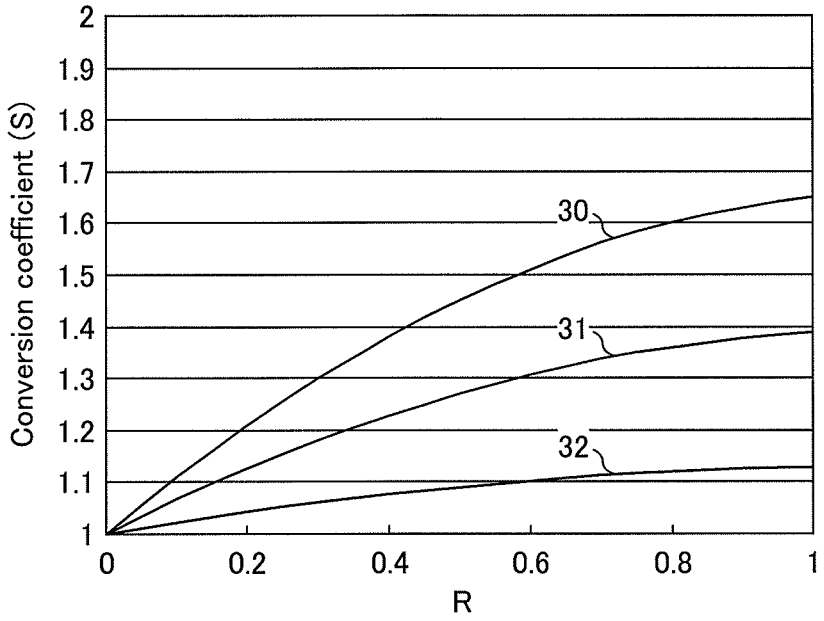
FIG. 3 is a graph indicative of a curve representing a relation between a grayscale ratio used by a conversion coefficient calculating section of the display device shown in FIG. 1 and a conversion coefficient.

FIG. 3 is a graph indicative of a curve representing a relation between a grayscale ratio used by the conversion coefficient calculating section 4 of the display device shown in FIG. 1 and a conversion coefficient. In this graph, the x-axis indicates a grayscale ratio (R) and the y-axis indicates a conversion coefficient (S).

The conversion coefficient calculating section 4 calculates the conversion coefficient by using curves shown in FIG. 3 and based on a grayscale ratio calculated from RGB data corresponding to each pixel. For example, in a case where the grayscale ratio of a certain pixel is 0.8, the conversion coefficient calculated by using a curve 30 is 1.6.

As described above, the conversion coefficient is derived when the grayscale ratio of a pixel is calculated. Accordingly, with respect to the same grayscale ratio, as the inclination of the curve is larger (e.g. curve 30), luminance of white is emphasized more so that an image is displayed with higher luminance, and as the inclination of the curve is smaller (e.g. curve 32), luminance of white is subdued so that colors of R, G, B, C, M, and Y are displayed more vividly.

The inclination of the curve may be set by using the ratio of the number of target pixels (deep-color pixels) detected by the detection section 3. An example of a method for setting the inclination of the curve in accordance with the ratio of the number of target pixels is a method using a relational expression indicative of a relation between an inclination coefficient (K) for setting the inclination of the curve and the ratio of the number of target pixels.

Figure 4:
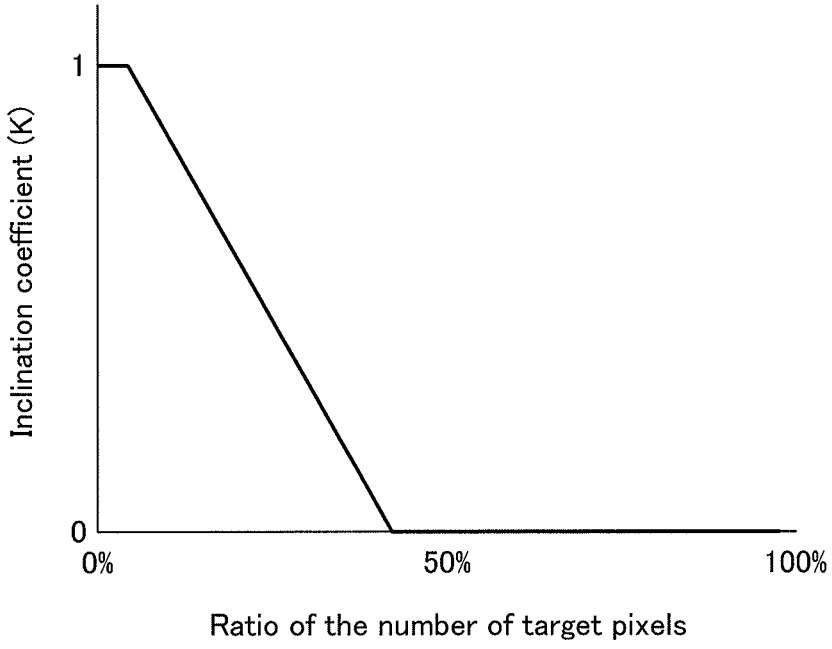
FIG. 4 is a graph showing a relation between the ratio of the number of target pixels and an inclination coefficient.

FIG. 4 is a graph showing a relation between the ratio of the number of target pixels and the inclination coefficient. In the graph shown in FIG. 4, the x-axis indicates the ratio of the number of target pixels and the y-axis indicates the inclination coefficient (K).

The inclination coefficient is a coefficient for increasing/decreasing the inclination of the curve used for calculating the conversion coefficient. The inclination coefficient is not particularly limited, and may range from 0 to 1 for example. As the inclination coefficient is larger, the inclination of the curve increases, and as the inclination coefficient is smaller, the inclination of the curve decreases.

As shown in FIG. 4, since the ratio of the number of target pixels being smaller indicates that more number of areas are displayed with pale colors, the inclination coefficient is larger. Since the ratio of the number of target pixels being larger indicates that more number of areas are displayed with deep colors, the inclination coefficient is smaller.

Here, the pale color indicates a color expressed with a grayscale ratio ranging from 0.9 to 1 for example, and the deep color indicates a color expressed with a grayscale ratio ranging from 0 to 0.1 for example.

Figure 5:
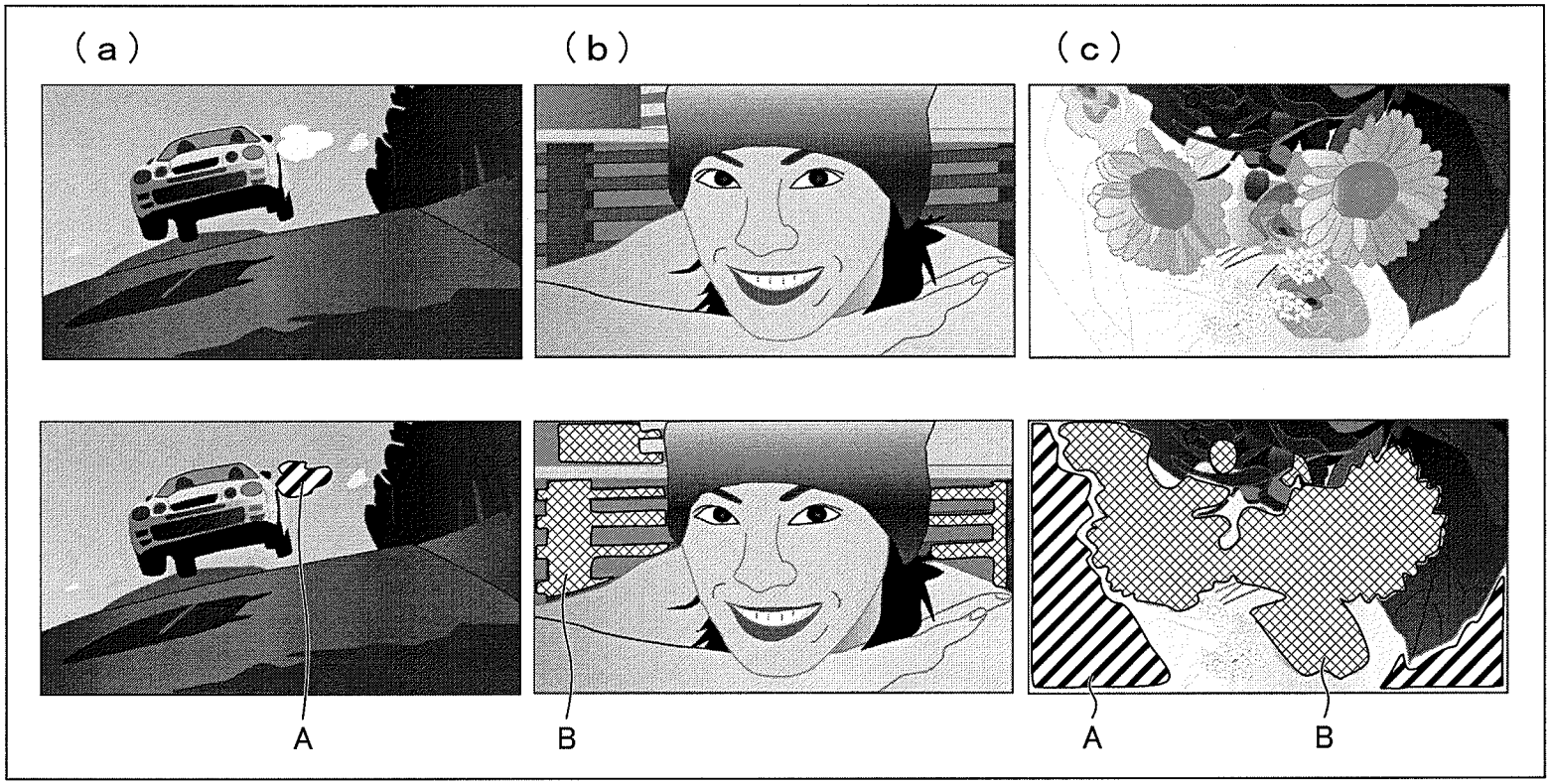
FIG. 5 is a view showing display examples of images with different ratios of areas with deep colors to areas with pale colors.

For example, FIG. 5 shows three kinds of images (a) to (c) with different ratios of the number of deep-color pixels. FIG. 5 shows display examples of images with different ratios of areas with deep colors to areas with pale colors. The upper row shows displayed images. The lower row shows distributions of depth in the images in the upper rows.

In FIG. 5, a large part of an image (a) is occupied by an area A with pale colors, and the ratio of the number of deep-color pixels is 0.03% for example. Since it is preferable that the image (a) is displayed with higher priority on luminance of a screen than vividness of colors, the inclination is set to be large.

In an image (b), a larger part is occupied by an area B with deep colors than in the image (a), and the ratio of the number of deep-color pixels is 8% for example. Since it is preferable that the image (b) is displayed with a well-balanced relation between vividness of colors and luminance of a screen, the inclination for the image (b) is set to be smaller than that for the image (a).

In an image (c), a further larger part is occupied by the area B with deep colors, and the ratio of the number of deep-color pixels is 25% for example. Since it is preferable that the image (c) is displayed with higher priority on vividness of colors than luminance of a screen, the inclination for the image (c) is set to be further smaller.

The conversion coefficient calculating section 4 can generate a curve for calculating a conversion coefficient by further using the result of the determination by the determination section 7. Specifically, the conversion coefficient calculating section 4 sets the segment of the curve in accordance with the result of the determination by the determination section 7.

As described above, the determination section 7 refers to the RGBW data to which the RGB data has been converted by the RGB data conversion section 5, and counts the number of pixels specified to display an image with RGB grayscales one of which exceeds the maximum grayscale. Then, the determination section 7 determines whether a ratio of the number of the specified pixels to the number of all the pixels is more than a predetermined upper limit or less than a predetermined lower limit.

Figure 6:
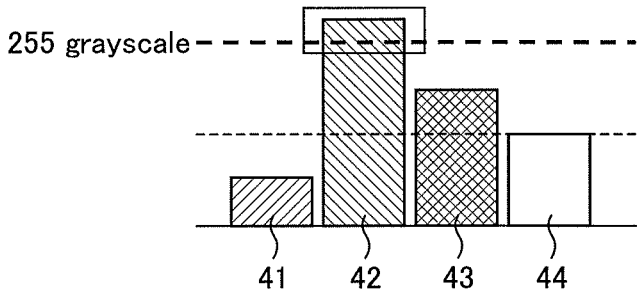
FIG. 6 is a view showing an example of a pixel specified to display with a grayscale exceeding the maximum grayscale in RGBW data.

That is, when the RGB data conversion section 5 generates RGBW data, there is a case where a grayscale exceeds the maximum grayscale due to extension of RGB grayscales. For example, in FIG. 6, G grayscale (component 42) is specified to display with a grayscale larger than 255 grayscales which is the maximum grayscale. FIG. 6 is a view showing an example of a pixel specified to display with a grayscale exceeding the maximum grayscale in RGBW data.

In this case, since the upper limit expressible with the G grayscale is 255 grayscale, there is a possibility that a balance between G and other colors is off so that a color different from a color indicated by the original data is displayed.

In order to deal with this problem, when the ratio of the number of pixels specified to display with a grayscale exceeding 255 grayscale to the number of all the pixels is more than 2% for example, the conversion coefficient calculating section 4 shifts the segment of the curve in a downward direction. This reduces the values to which RGB grayscales are extended, thereby reducing the number of pixels whose grayscale exceeds 255 grayscale.

On the other hand, when the ratio of the number of pixels specified to display with a grayscale exceeding 255 grayscale to the number of all the pixels is less than 1% for example, the conversion coefficient calculating section 4 shifts the segment of the curve in an upward direction. When the ratio of the number of pixels whose grayscale exceeds the maximum grayscale is small, there is a possibility that luminance of a whole image is not sufficient. In order to deal with this, the values to which RGB grayscales are extended are made larger, so that the image can be displayed with sufficient luminance.

With reference to the three kinds of images shown in FIG. 5 as examples, an explanation is made here as to how to set the segment of a curve.

Figure 7:
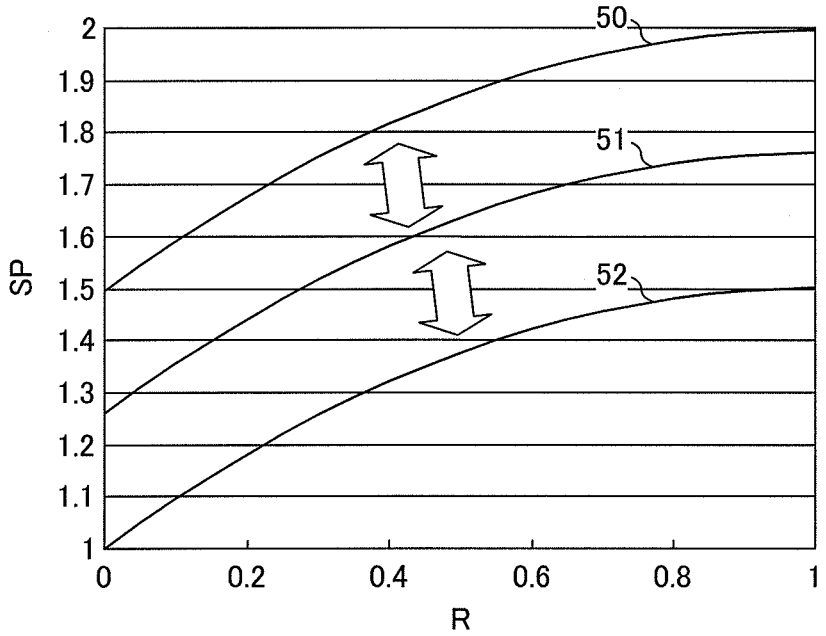
FIG. 7 is a graph showing movement of a segment of a curve used when displaying an image (a) shown in FIG. 5.

FIG. 7 is a graph showing movement of the segment of a curve used when displaying the image (a) shown in FIG. 5. Since the image (a) has a large ratio of the number of deep-color pixels, the inclination of the curve is large as shown in FIG. 7.

Here, when the ratio of the number of pixels specified to display with a grayscale exceeding 255 grayscale to the number of all the pixels is more than 2% for example, a curve 50 is shifted in a y-axis downward direction to be closer to a curve 51. On the other hand, when the ratio of the number of pixels specified to display with a grayscale exceeding 255 grayscale to the number of all the pixels is less than 1% for example, a curve 52 is shifted in a y-axis upward direction to be closer to the curve 51.

Figure 8:
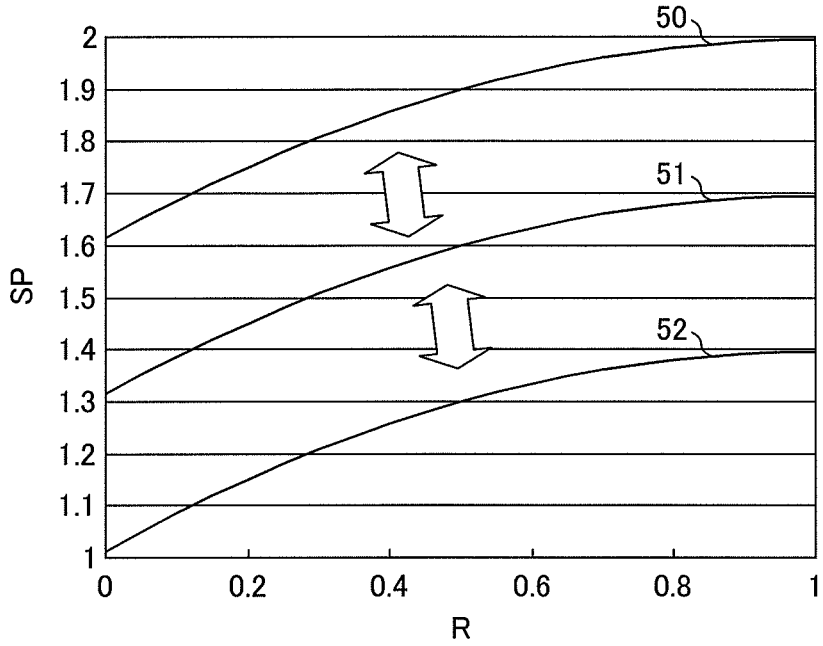
FIG. 8 is a graph showing movement of a segment of a curve used when displaying an image (b) shown in FIG. 5.

FIG. 8 is a graph showing movement of the segment of a curve used when displaying the image (b) shown in FIG. 5. Since the image (b) has a larger ratio of the number of deep-color pixels than the image (a) as described above, the inclination of the curve used when displaying the image (b) is smaller than the inclination of the curve used when displaying the image (a).

Also in the case of this curve, when the ratio of the number of pixels specified to display with a grayscale exceeding 255 grayscale to the number of all the pixels is more than 2% for example, a curve 50 is shifted in a y-axis downward direction to be closer to a curve 51. On the other hand, when the ratio of the number of pixels specified to display with a grayscale exceeding 255 grayscale to the number of all the pixels is less than 1% for example, a curve 52 is shifted in a y-axis upward direction to be closer to the curve 51.

Figure 9:
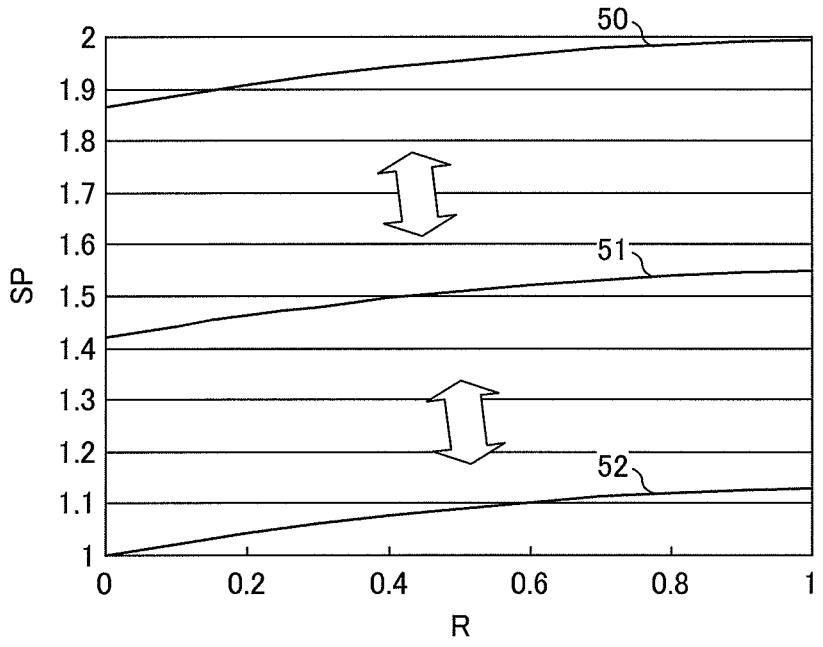
FIG. 9 is a graph showing movement of a segment of a curve used when displaying an image (c) shown in FIG. 5.

Furthermore, also in the case of the curve with a smaller inclination used when displaying the image (c) shown in FIG. 5, when there are a large number of pixels specified to display with a grayscale exceeding the maximum grayscale, the curve is shifted in a y-axis downward direction, and when there are a small number of such pixels, the curve is shifted in a y-axis upward direction. FIG. 9 is a graph showing movement of the segment of a curve used when displaying the image (c) shown in FIG. 5.

As described above, a segment (C) of the curve is shifted upward or downward depending on whether the ratio of the number of pixels whose grayscale exceeds the maximum grayscale is more than a predetermined upper limit or less than a predetermined lower limit, so that it is possible to display an image with excellent color reproducibility and sufficient luminance.

The determination section 7 makes determination by referring to RGBW data to which RGB data of a certain frame has been converted. Accordingly, the result of the determination by the determination section 7 is used when the conversion coefficient calculating section 4 finds a segment in a frame next to the certain frame. However, since there is little difference between images displayed in successive frames, there is no problem in display.

A curve having an inclination derived from the ratio of the number of target pixels and having a segment derived from the result of determination by the determination section 7 can be expressed by formula (1) below for example.

$$\text{Conversion coefficient}(S)=(-0.5\times R^2+1.15\times R)\times K+C \quad (1)$$

wherein R represents a grayscale ratio, K represents an inclination coefficient, and C represents a segment. The conversion coefficient calculating section 4 can easily obtain a conversion coefficient by using the formula (1).

(Method for Controlling Display Device 100)

Figure 10:
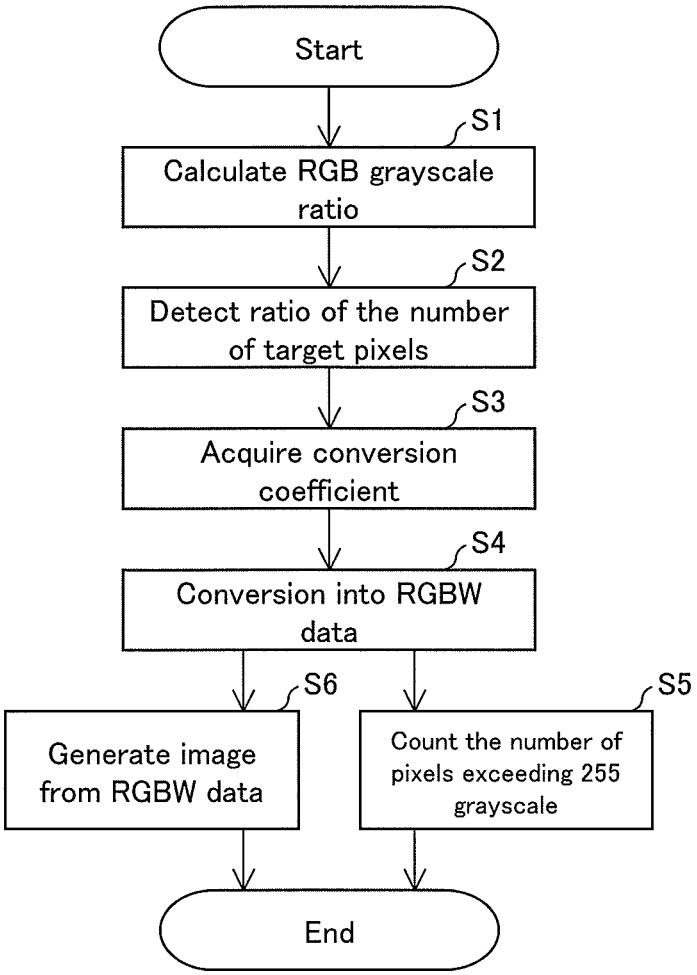
FIG. 10 is a flowchart showing a flow from a process of acquiring RGB data to a process of displaying an image.

Next, with reference to a flowchart shown in FIG. 10, an explanation is made as to a flow from a process in which the display device 100 in accordance with the present embodiment acquires RGB data to a process in which the display device 100 displays an image. FIG. 10 is a flowchart showing the flow from the process of acquiring RGB data to the process of displaying an image.

Initially, when the RGB data acquiring section 1 acquires RGB data from an outside source, the grayscale ratio calculating section 2 calculates a ratio of the lowest grayscale to the highest grayscale of RGB grayscales in each pixel which are indicated by the RGB data (step S1).

The detection section 3 detects a ratio of the number of target pixels whose grayscale ratio calculated by the grayscale ratio calculating section 2 is not more than 0.1 (step S2).

Next, the conversion coefficient calculating section 4 determines, in accordance with the ratio of the number of target pixels detected in the step S2, an inclination of a curve for obtaining a conversion coefficient, and acquires a conversion coefficient corresponding to grayscale ratios of individual pixels (step S3).

In this process, by counting pixels whose grayscale exceeds 255 grayscale by referring to RGBW data to which RGB data has been converted in a previous frame for example, it is possible to obtain a conversion coefficient by using a curve whose segment has been shifted based on the result of counting. The RGB data conversion section 5 converts RGB data into RGBW data by using the conversion coefficient (step S4).

The determination section 7 counts pixels whose grayscale exceeds 255 grayscale by referring to the RGBW data to which the RGB data has been converted in the step S4, and makes determination for shifting the segment of the curve used by the conversion coefficient calculating section 4 in accordance with the number of counts (step S5). The result of this determination is used for the conversion coefficient calculating section 4 to shift the segment of the curve in a next frame.

Next, the RGB data conversion section 5 transmits, to the display control section 6, the RGBW data to which the RGB data has been converted. Based on the RGBW data, the display control section 6 generates control signals for controlling the source driver 9 and the gate driver 10, respectively, and transmits the control signals.

In accordance with the received control signals, the source driver 9 and the gate driver 10 apply voltages on RGBW subpixels in each pixel, and controls transmittances of the RGBW subpixels, thereby expressing a color. Thus, the display panel 20 displays an image indicated by the RGBW data (step S6).

(Control of Luminance of Backlight 12)

The display device 100 in accordance with the present embodiment can control luminance of the backlight 12 in accordance with the conversion coefficient when the grayscale ratio is 1.

The display device 100 changes the inclination of the curve for obtaining the conversion coefficient in accordance with the ratio of the number of deep-color pixels. For example, in a case where the ratio of the number of deep-color pixels is small, the inclination of the curve is increased so that luminance of white (grayscale ratio is 1) is increased. In this case, it is possible to display an image with high luminance.

In contrast thereto, in a case where the ratio of the number of deep-color pixels is large, the inclination of the curve is decreased so that luminance of white (grayscale ratio is 1) is decreased. In this case, a color indicated by RGB is displayed vividly. However, there is a case where luminance is not sufficient.

In order to deal with this, in the present embodiment, the backlight control section 11 controls luminance of the backlight 12 in accordance with the conversion coefficient when the grayscale ratio is 1. That is, a low grayscale of each pixel is compensated by controlling luminance of the backlight 12.

Specifically, based on the curve generated by the conversion coefficient calculating section 4 to obtain a conversion coefficient, the backlight control section 11 obtains the conversion coefficient when the grayscale ratio is 1, and controls luminance of the backlight 12 in accordance with the obtained conversion coefficient.

Figure 11:
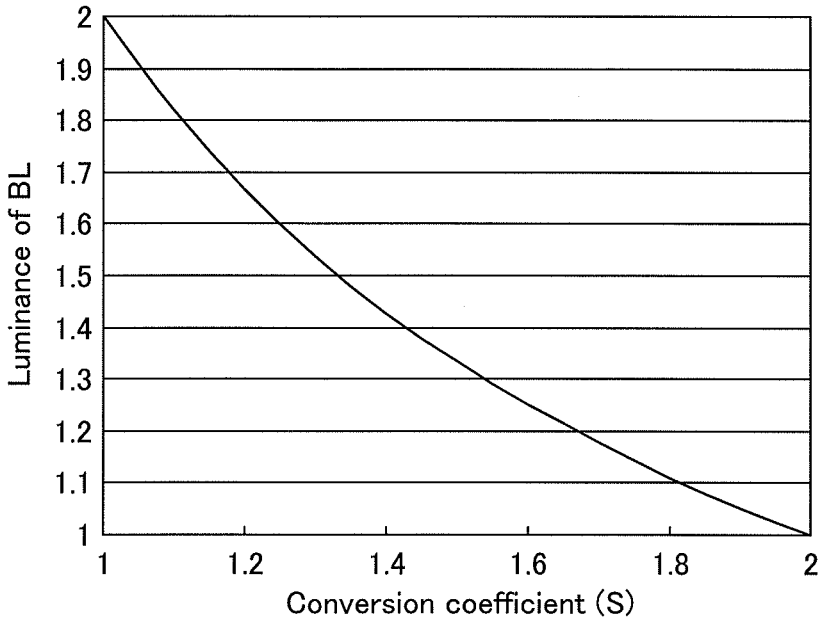
FIG. 11 is a graph showing a relation between luminance of a backlight used by a backlight control section of the display device shown in FIG. 1 and the conversion coefficient.
Figure 12:
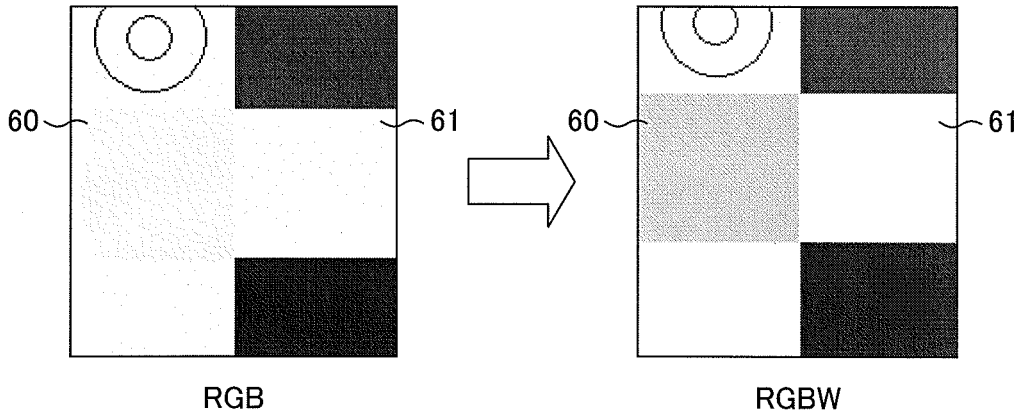
FIG. 12 is a view showing how colors are displayed when RGB data is converted into RGBW data by a conventional method.

For example, as shown in FIG. 11, the backlight control section 11 controls luminance of the backlight 12 in such a manner that the luminance is lower as the conversion coefficient when the grayscale ratio is 1 is larger, and the luminance is higher as the conversion coefficient is smaller.

FIG. 11 is a graph showing a relation between luminance of the backlight 12 used by the backlight control section 11 of the display device 100 shown in FIG. 1 and the conversion coefficient.

In FIG. 11, x-axis indicates a conversion coefficient (S) when the grayscale ratio is 1, and y-axis indicates a ratio of increasing luminance of the backlight 12. Furthermore, in the range of the ratio of increasing luminance of the backlight 12 on the x-axis, "1" indicates standard luminance of the backlight 12.

The ratio of increasing luminance of the backlight 12 ranges from 1 to 2 times. However, the present invention is not limited to this range.

As shown in FIG. 11, the backlight control section 11 controls luminance of the backlight 12 in such a manner that the luminance of the backlight 12 is higher as the conversion coefficient when the grayscale ratio is 1 is smaller, and the luminance is closer to a standard value as the conversion coefficient is closer to 2. This allows displaying an image with sufficient luminance even when high priority is put on color.

(Program and Recording Medium)

Lastly, each section of the display device 100 may be realized by hardware logic or may be realized by software by using CPUs as described below.

Namely, the display device 100 includes: CPUs for executing a program for realizing each function; ROMs that store the program; RAMs that develop the program in an executable form; storage devices (storage mediums) such as memories that store the program and various data. With this configuration, the object of the present invention can be realized by a predetermined storage medium.

This storage medium may be a computer-readable storage medium for storing program codes (such as executable program, intermediate code program, and source program) of programs of the display device 100 which programs serve as software for realizing the functions. The display device 100 is provided with this storage medium. Thus, the display device 100 as a computer (or CPU or MPU) reads out and executes the program codes stored in the storage medium.

The storage medium for supplying the program codes to the display device 100 is not limited to a particular structure or kind. The storage medium is, for example, tapes such as a magnetic tape and a cassette tape, or discs such as magnetic discs (e.g. a floppy Disc® and a hard disc), and optical discs (e.g. CD-ROM, MO, MD, DVD, and CD-R). Further, the storage medium may be cards such as an IC card (including a memory card) and an optical card, or semiconductor memories such as mask ROM, EPROM, EEPROM, and flash ROM.

The object of the present invention can be realized also by arranging the display device 100 to be connectable to a communication network. In this case, the program codes are supplied to the display device 100 via the communication network. The communication network is not limited to a particular kind or form as long as it can supply program codes to the display device 100. Examples of the communication network include the Internet, intranet, extranet, LAN, ISDN, VAN, CATV communication network, virtual private network, telephone network, mobile communication network, and satellite communication network.

A transmission medium that constitutes the communication network is not limited to a particular structure or kind. Examples of the transmission medium include (i) wired lines such as IEEE 1394, USB, power-line carrier, cable TV lines, telephone lines, and ADSL (Asymmetric Digital Subscriber Line) and (ii) wireless connections such as IrDA and remote control using infrared ray, Bluetooth®, 802.11, HDR, mobile phone network, satellite connections, and terrestrial digital network.

The present invention is not limited to the description of the embodiments above, but may be altered by a skilled person within the scope of the claims. An embodiment based on a proper combination of technical means disclosed in different embodiments is encompassed in the technical scope of the present invention.

(Others)

It is preferable to arrange the display device in accordance with one aspect of the present invention such that the conversion means converts the RGB data into the RGBW data by regarding a lowest one of RGB grayscales indicated by the RGB data as a W grayscale and multiplying the RGB grayscales with the conversion coefficient to extend the RGB grayscales and thereafter subtracting the W grayscale from each of the extended RGB grayscales.

With the arrangement, when extending RGB grayscales, the conversion coefficient with which individual grayscales are multiplied is acquired in accordance with the ratio of the number of the target pixel.

Therefore, by reducing the difference between the ratio of extending RGB grayscales when displaying the target pixel and the ratio of extending RGB grayscales when displaying white, it is possible to vividly display so-called deep colors such as R, G, B, C (cyan), M (magenta), and Y (yellow).

It is preferable to arrange the display device in accordance with one aspect of the present invention such that the conversion coefficient acquiring means acquires the conversion coefficient by using a curve indicative of a relation between the ratio calculated by the calculating means and the conversion coefficient, as the ratio of the number of the target pixel which is detected by the detection means is larger, the curve used by the conversion coefficient acquiring means for acquiring the conversion coefficient has a smaller inclination, and as the ratio of the number of the target pixel which is detected by the detection means is smaller, the curve used by the conversion coefficient acquiring means for acquiring the conversion coefficient has a larger inclination.

As described above, the ratio calculated by the calculating means is a ratio of a lowest grayscale to a highest grayscale. Accordingly, when the difference between these grayscales is large, the ratio is close to 0, and when the difference is small, the ratio is close to 1. For example, assume that an x-axis for a curve indicates the ratio and a y-axis for the curve indicates the conversion coefficient. At that time, determining the ratio derives a corresponding conversion coefficient.

When the inclination of the curve is small, the difference in conversion coefficient between when the ratio calculated by the calculating means is 0 and when the ratio is 1 is small. Consequently, the difference in luminance between when colors such as R, G, and B are displayed and when white is displayed is small, so that it is possible to display an image with high priority on vividness of colors.

On the other hand, when the inclination of the curve is large, the difference in conversion coefficient between when the ratio calculated by the calculating means is 0 and when the ratio is 1 is large. Consequently, luminance of white is high, so that it is possible to display an image with high priority on luminance.

It is preferable to arrange the display device in accordance with one aspect of the present invention so as to further include determination means for counting the number of pixels specified to display with RGB grayscales one of which exceeds a maximum grayscale in RGBW data to which RGB data has been converted in a previous frame and determining whether a ratio of the number of the specified pixels to the number of all pixels is more than a predetermined upper limit or less than a predetermined lower limit, when the determination means determines that the ratio is more than the predetermined upper limit, the curve used by the conversion coefficient acquiring means for acquiring the conversion coefficient is shifted in y-axis upward direction, and when the determination means determines that the ratio is less than the predetermined lower limit, the curve used by the conversion coefficient acquiring means for acquiring the conversion coefficient is shifted in y-axis downward direction.

With the arrangement, it is possible to display an image with high color reproducibility and sufficient luminance.

It is preferable to arrange the display device in accordance with one embodiment of the present invention so as to further include light source control means for acquiring, by using the curve, the conversion coefficient when the ratio calculated by the calculating means is 1 and controlling luminance of the backlight in accordance with the acquired conversion coefficient, the light source control means controlling the luminance of the backlight in such a manner that as the conversion coefficient is larger, the luminance of the backlight is lower, and as the conversion coefficient is smaller, the luminance of the backlight is higher.

With the arrangement, the luminance of the backlight is controlled in accordance with the conversion coefficient when white is displayed, so that it is possible to display an image with sufficient luminance when high priority is put on colors.

It is preferable to arrange the display device in accordance with one aspect of the present invention such that the display panel is a liquid crystal display panel.

With the arrangement, it is possible to display an image with high luminance and with vivid colors.

The display device may be realized by a computer. In this case, a program for causing the computer to function as individual means and a computer-readable recording medium in which the program is recorded are also encompassed in the scope of the present invention.

INDUSTRIAL APPLICABILITY

The present invention is preferably applicable to various display devices of, for example, television receivers, personal computers, mobile phones, and game machines.

REFERENCE SIGNS LIST

1 RGB Data Acquiring Section
2 Grayscale Ratio Calculating Section (calculating means)
3 Detection Section (detection means)
4 Conversion Coefficient Calculating Section (conversion coefficient acquiring means)
5 RGB Data Conversion Section (conversion means)
6 Display Control Section (display means)
7 Determination Section (determination means)
8 Timing Control Section
9 Source Driver
10 Gate Driver
11 Backlight Control Section (light source control means)
12 Backlight
20 Display Panel
100 Display Device

The invention claimed is:

1. A display device, comprising:

a display panel having pixels each constituted by subpixels of red (R), green (G), blue (B), and white (W);

a backlight configured to emit light to the display panel; and control circuitry configured to acquire RGB data and calculate a grayscale ratio of a lowest grayscale to a highest grayscale of RGB grayscales in each pixel which are indicated by the acquired RGB data, determine that a pixel, which has the calculated grayscale ratio not more than a predetermined value, is a target pixel to be detected, and detect, from the RGB data, a ratio of a number of target pixels in one frame, acquire, by using the ratio of the number of the target pixels in one frame, a conversion coefficient for converting the RGB data into RGBW data, convert the RGB data into the RGBW data with respect to each pixel by using the conversion coefficient, and generate, from the RGBW data to which the RGB data has been converted, an image to be displayed on the display panel, and cause the display panel to display the image, wherein the control circuitry is configured to acquire the conversion coefficient by using a curve indicative of a relation between the calculated grayscale ratio and the conversion coefficient, wherein as the ratio of the number of the target pixels in one frame is larger, the curve used for acquiring the conversion coefficient has a smaller inclination, and as the ratio of the number of the target pixels in one frame is smaller, the curve used for acquiring the conversion coefficient has a larger inclination, and the control circuitry is further configured to count a number of pixels specified to display with RGB grayscales one of which exceeds a maximum grayscale in RGBW data to which RGB data has been converted in a previous frame, and determine whether a ratio of the number of the specified pixels to the number of all pixels is more than a predetermined upper limit or less than a predetermined lower limit, wherein when the ratio of the number of the specified pixels to the number of all pixels is more than the predetermined upper limit, the curve used for acquiring the conversion coefficient is shifted in a y-axis upward direction, and when the ratio of the number of the specified pixels to the number of all pixels is less than the predetermined lower limit, the curve used for acquiring the conversion coefficient is shifted in a y-axis downward direction.

2. The display device as set forth in claim 1, wherein the control circuitry is configured to convert the RGB data into the RGBW data by regarding the lowest grayscale of the RGB grayscales indicated by the RGB data as a W grayscale, and multiplying the RGB grayscales with the conversion coefficient to extend the RGB grayscales, and thereafter subtracting the W grayscale from each of the extended RGB grayscales.

3. The display device as set forth in claim 1, wherein the display panel is a liquid crystal display panel.

4. A display device, comprising:

a display panel having pixels each constituted by subpixels of red (R), green (G), blue (B), and white (W);

a backlight configured to emit light to the display panel; and control circuitry configured to acquire RGB data and calculate a grayscale ratio of a lowest grayscale to a highest grayscale of RGB grayscales in each pixel which are indicated by the acquired RGB data, determine that a pixel, which has the calculated grayscale ratio not more than a predetermined value, is a target pixel to be detected, and detect, from the RGB data, a ratio of a number of target pixels in one frame, acquire, by using the ratio of the number of the target pixels in one frame, a conversion coefficient for converting the RGB data into RGBW data, convert the RGB data into the RGBW data with respect to each pixel by using the conversion coefficient, and generate, from the RGBW data to which the RGB data has been converted, an image to be displayed on the display panel, and cause the display panel to display the image, wherein the control circuitry is configured to acquire the conversion coefficient by using a curve indicative of a relation between the calculated grayscale ratio and the conversion coefficient, wherein as the ratio of the number of the target pixels in one frame is larger, the curve used for acquiring the conversion coefficient has a smaller inclination, and as the ratio of the number of the target pixels in one frame is smaller, the curve used for acquiring the conversion coefficient has a larger inclination, and the control circuitry is further configured to acquire, by using the curve, the conversion coefficient when the calculated grayscale ratio is 1, and control luminance of the backlight in accordance with the acquired conversion coefficient, in such a manner that as the conversion coefficient is larger, the luminance of the backlight is lower, and as the conversion coefficient is smaller, the luminance of the backlight is higher.

5. The display device as set forth in claim 4, wherein the control circuitry is configured to convert the RGB data into the RGBW data by regarding the lowest grayscale of the RGB grayscales indicated by the RGB data as a W grayscale, and multiplying the RGB grayscales with the conversion coefficient to extend the RGB grayscales, and thereafter subtracting the W grayscale from each of the extended RGB grayscales.

6. The display device as set forth in claim 4, wherein the display panel is a liquid crystal display panel.

7. A method for controlling a display device including a display panel having pixels each constituted by subpixels of red (R), green (G), blue (B), and white (W), and a backlight for emitting light to the display panel, the method comprising the steps of:

(i) acquiring RGB data and calculating a ratio of a lowest grayscale to a highest grayscale of RGB grayscales in each pixel which are indicated by the acquired RGB data;

(ii) determining that a pixel, which has the ratio calculated in the step (i) not more than a predetermined value, is a target pixel to be detected, and detecting, from the RGB data, a ratio of a number of target pixels in one frame;

(iii) acquiring, by using the ratio detected in the step (ii), a conversion coefficient for converting the RGB data into RGBW data;

(iv) converting the RGB data into the RGBW data by using the conversion coefficient acquired at the step (iii); and (v) generating, from the RGBW data to which the RGB data has been converted in the step (iv), an image to be displayed on the display panel, and causing the display panel to display the image, wherein in the step (iii), the conversion coefficient is acquired by using a curve indicative of a relation between the ratio calculated in the step (i) and the conversion coefficient, wherein as the ratio of the number of the target pixels in one frame detected in the step (ii) is larger, the curve used for acquiring the conversion coefficient has a smaller inclination, and as the ratio of the number of the target pixels in one frame detected in the step (ii) is smaller, the curve used for acquiring the conversion coefficient has a larger inclination, and the method further comprises:

counting a number of pixels specified to display with RGB grayscales one of which exceeds a maximum grayscale in RGBW data to which RGB data has been converted in a previous frame; and determining whether a ratio of the number of the specified pixels to the number of all pixels is more than a predetermined upper limit or less than a predetermined lower limit, wherein when the ratio of the number of the specified pixels to the number of all pixels is more than the predetermined upper limit, the curve used for acquiring the conversion coefficient is shifted in a y-axis upward direction, and when the ratio of the number of the specified pixels to the number of all pixels is less than the predetermined lower limit, the curve used for acquiring the conversion coefficient is shifted in a y-axis downward direction.

* * * * *